US010932023B2

(12) United States Patent
Feng

(10) Patent No.: US 10,932,023 B2
(45) Date of Patent: Feb. 23, 2021

(54) SPEAKER MODULE

(71) Applicant: AAC Technologies Pte. Ltd., Singapore (SG)

(72) Inventor: Lu Feng, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/703,890

(22) Filed: Dec. 5, 2019

(65) Prior Publication Data

US 2020/0213695 A1 Jul. 2, 2020

(30) Foreign Application Priority Data

Dec. 29, 2018 (CN) ..... 201811631125.9

(51) Int. Cl.
*H04R 1/02* (2006.01)

(52) U.S. Cl.
CPC ..... *H04R 1/025* (2013.01); *H04R 1/026* (2013.01); *H04R 2499/11* (2013.01)

(58) Field of Classification Search
CPC ..... H04R 1/025; H04R 1/026; H04R 2499/11
USPC ..... 381/386
See application file for complete search history.

(56) References Cited

U.S. PATENT DOCUMENTS

2003/0077945 A1* 4/2003 Hashiba ..... H04R 1/06 439/660
2006/0120553 A1* 6/2006 Saito ..... H04R 1/06 381/398
2009/0290744 A1* 11/2009 Wu ..... H04M 1/035 381/387
2016/0021452 A1* 1/2016 Tang ..... H04R 11/00 381/151
2017/0034629 A1* 2/2017 Mao ..... H04R 9/045

* cited by examiner

*Primary Examiner* — Sean H Nguyen
(74) *Attorney, Agent, or Firm* — W&G Law Group LLP

(57) ABSTRACT

The present invention provides a speaker module, including: a housing; a speaker unit having a frame and a working pad fixed to the frame for electrically connecting the speaker unit to an external circuit; a cover engaging with the frame for forming an accommodating space for receiving the speaker unit. The cover includes a conductive part formed thereon, a conductive pin formed on one side of the cover for electrically connecting with the working pad of the speaker unit, and a conductive terminal formed on the other side of the cover for electrically connecting with the external circuit.

7 Claims, 3 Drawing Sheets

SPEAKER MODULE

FIELD OF THE PRESENT DISCLOSURE

The present disclosure relates to the field of electroacoustic transducers, more particularly to a speaker module used in a mobile device.

DESCRIPTION OF RELATED ART

The speaker module is an important acoustic part of the portable electronic equipment and can convert electric energy into sound energy to radiate out. With the rapid development of the electronic technology, the speaker module is widely applied to various portable electronic devices.

In the prior art, a speaker module includes a Flexible Printed Circuit Board (FPCB) as an internal connecting part to electrically connect a speaker unit with an external circuit. As shown in FIG. 1, the speaker module 10 comprises a housing 11, a speaker unit 13, an FPCB 15 and a cover 17.

One end of the FPCB 15 is electrically connected with the speaker unit 13, and the other end of the FPCB 15 is connected with an external circuit.

In order to improve the strength of the FPCB, the reliability of the circuit in the FPCB is ensured, and a reinforcing plate needs to be arranged on the FPCB, especially on a bonding pad part of the FPCB, so that the effect of the reinforcing plate is especially obvious.

According to the speaker module in the related technology, the reinforcing plate is a non-conductive material. When the bonding pad part of the FPCB is of a double-sided bonding pad design, the reinforcing part of the non-conductive material enables one surface bonding pad of the bonding pad part to not be electrically connected with other parts, so that the flexibility of the design of the speaker module is limited.

On the other hand, due to the flexibility of the FPCB, a certain space needs to be provided for accommodating the FPCB, so that the occupied space of the rear cavity of the speaker module 10 is large.

In addition, due to the fact that the number of elements of the FPCB is large, the assembly is difficult, and the production efficiency cannot be improved.

Therefore, it is necessary to provide an improvement to overcome the disadvantages of the speaker module in the related technologies.

BRIEF DESCRIPTION OF THE DRAWINGS

Many aspects of the exemplary embodiment can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to an exemplary embodiment. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

Figure 1:
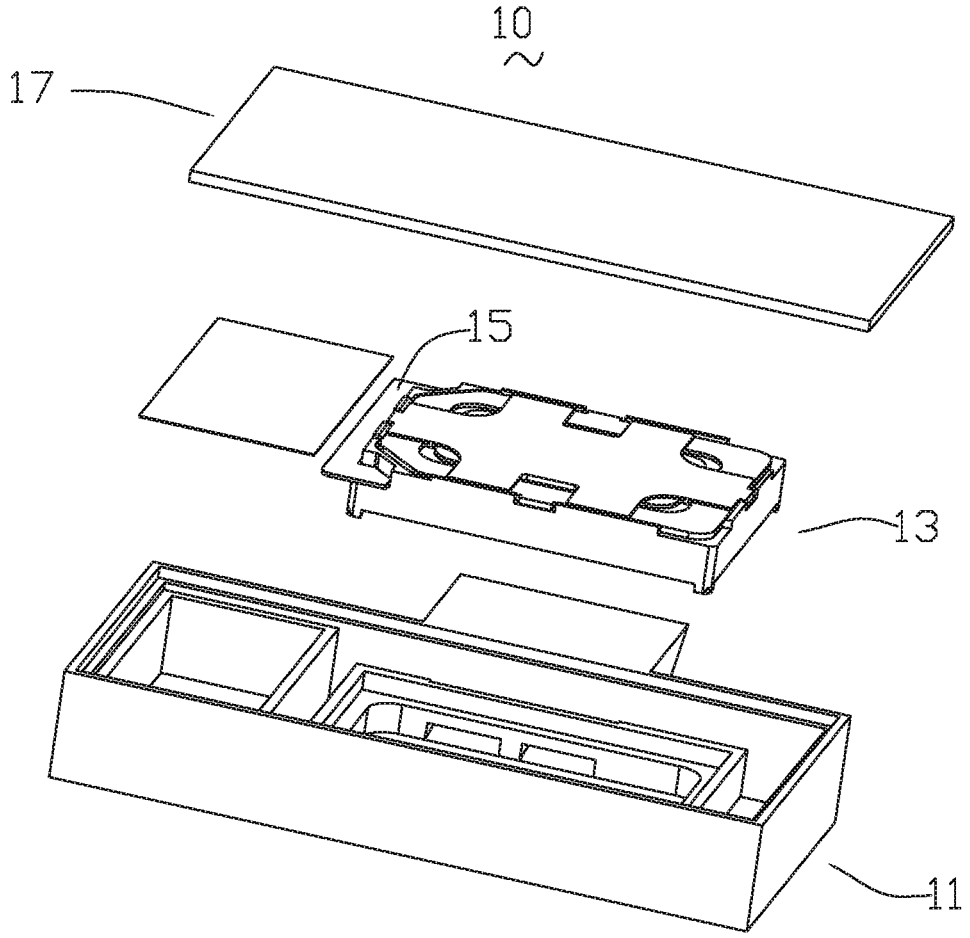
FIG. 1 is an isometric and exploded view of a speaker module of a related art.
Figure 2:
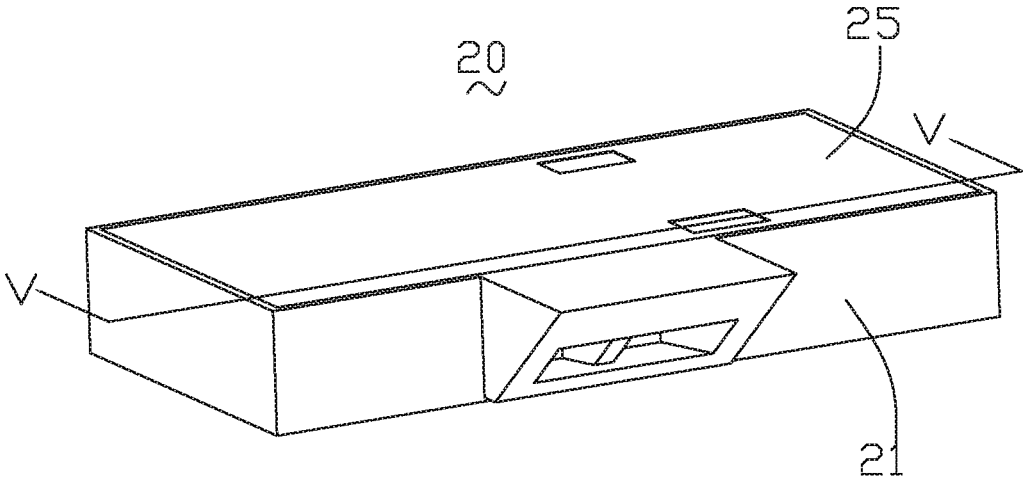
FIG. 2 is an isometric view of a speaker module in accordance with an exemplary embodiment of the present invention.
Figure 3:
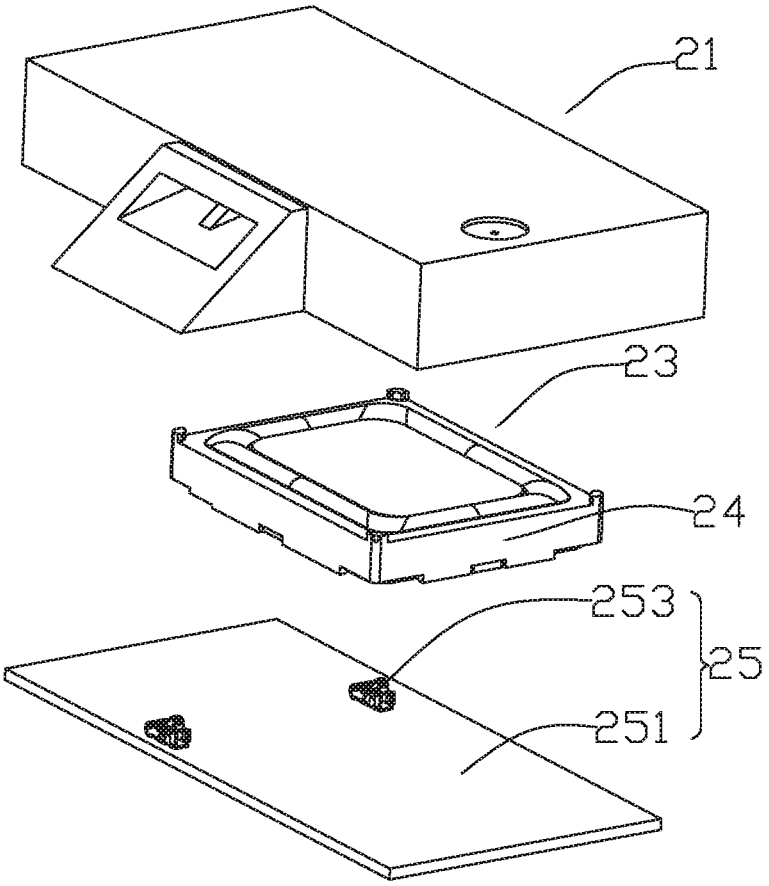
FIG. 3 is an isometric and exploded view of the speaker module shown in FIG. 2.

Referring to FIGS. 2-3, a speaker module 20 is provided by the present invention is used for converting electrical signals into audible sounds. The speaker module 20 includes a housing 21, a speaker unit 23, and a cover 25.

The housing 21 cooperates with the cover 25 to define an accommodation space for accommodating the speaker unit 23 therein. The speaker unit 23 is electrically connected with an external circuit through the cover 25. The housing 21 comprises an opening.

Figure 4:
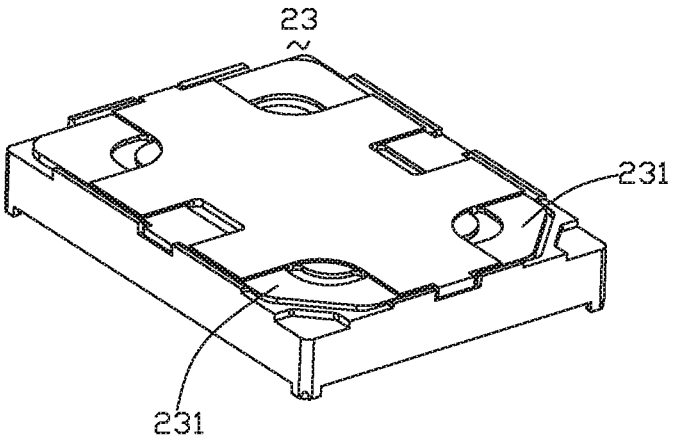
FIG. 4 is an isometric view of a speaker unit of the speaker module in FIG. 3.

Referring to FIG. 4, the speaker unit 23 comprises a frame 24 with a containing space and a working pad 231 formed on the frame and electrically connected with the external circuit. The number of the working pads 231 is multiple, and the multiple working pads 231 are located adjacent to the speaker unit 23.

Figure 5:
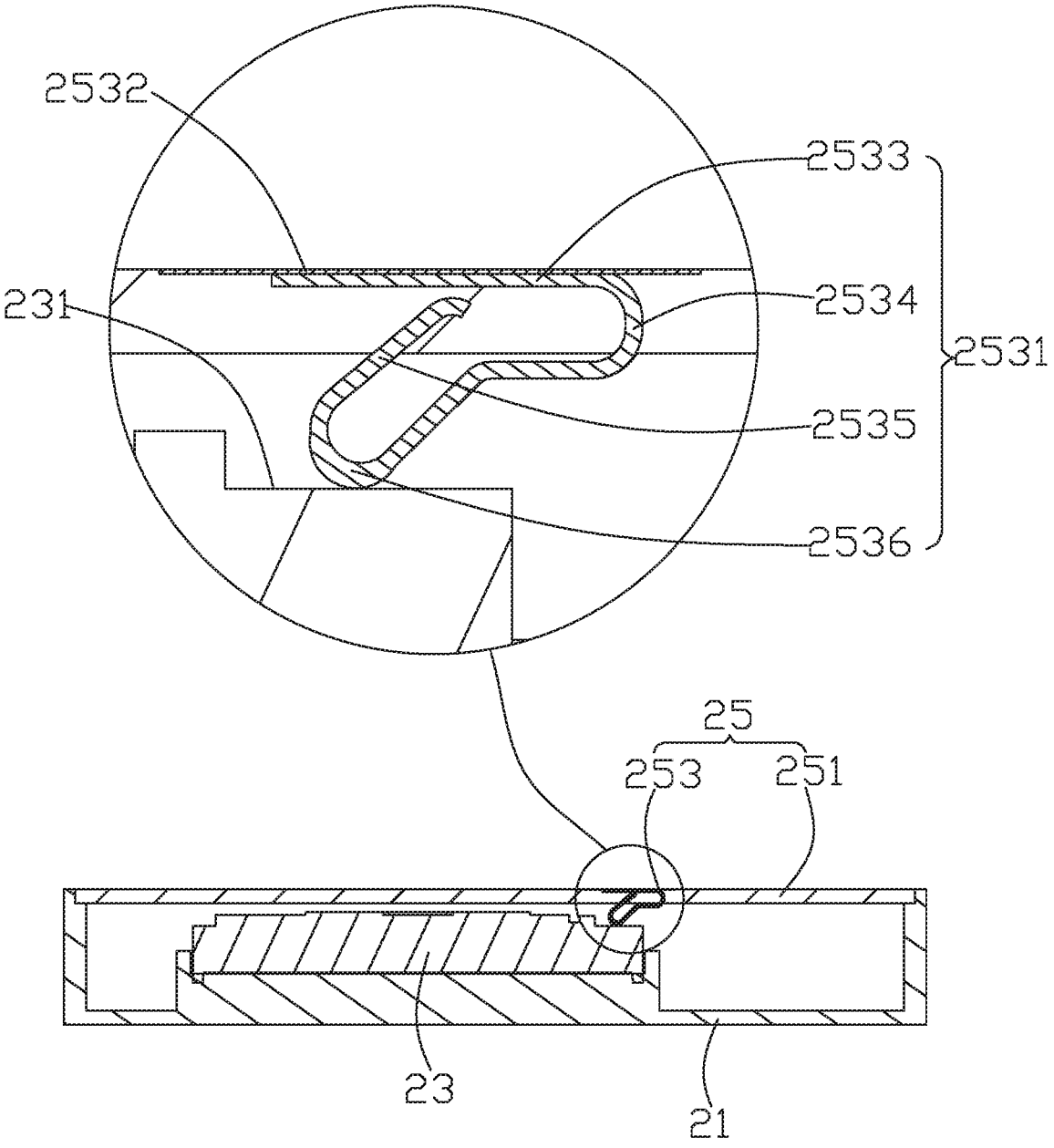
FIG. 5 is a cross-sectional view of the speaker module, taken along line V-V in FIG. 2.

Referring to FIGS. 3 and 5, the cover 25 is in a flat shape. The cover 25 correspondingly covers the opening of the housing 21 to enclose a closed space to accommodate the speaker unit 23. The cover 25 includes a body portion 251 and a conductive portion 253. The body potion 251 is flat, and an outer contour of the body portion 251 is consistent with an inner contour of the opening. The conductive portion 253 is embedded in the body portion 251. The number of the conductive portions 253 is multiple, and the conductive portions 253 are symmetrically arranged on an edge of the cover 25. In the present embodiment, the conductive portion 253 is embedded in the cover 25 through an injection molding process, penetrates through two opposite side surfaces of the cover 25, and is integrally formed with the cover 25.

The conductive portion 253 includes a conductive pin 2531 and a conductive terminal 2532 which are arranged on two opposite side surfaces of the cover 25. The conductive pin 2531 is disposed on a side surface of the cover 25 adjacent to the speaker unit 23, and extends from the surface of the cover 25 toward the speaker unit 23. The conductive terminal 2532 is arranged on the surface of the cover 25 far away from the side surface of the speaker unit 23, and the surface of the conductive terminal 2532 is exposed out of the surface of the cover 25.

The conductive pin 2531 is formed by processing any one of gold, silver, copper, tin and alloys thereof. The conductive pin 2531 comprises a body 2533, a connecting body 2534, an abutting body 2535 and an extension body 2536 which are connected in sequence, wherein the body 2533 is embedded in the cover 25, and the body 2533 is parallel to the surface of the cover 25. Two ends of the connecting body 2534 are respectively connected with one end of the body 2533 and one end of the abutting body 2535. After the abutting body 2535 is assembled, an electric connection between the abutting body 2535 and the working bonding pad 231 of the speaker unit 23 is achieved. One end of the extension body 2536 is connected with the abutting body 2535, and the other end of the extension body 2536 extends towards the cover 25. The abutting body 2535 protrudes from the surface of the cover 25 and exposes a protrusion towards the speaker unit 23. The body 2533 and the extension body 2536 are embedded in the cover 25.

The conductive terminal 2532 is disposed on the other side surface of the cover 25, and is formed by a conductive metal layer formed on the surface of the conductive pin 2531. The conductive terminal 2532 can be a gold layer plated on the surface of the conductive pin 2531. The conductive terminal 2532 covers the body 2533 of the conductive pin 2531, and is electrically connected with the body 2533 of the conductive pin. The conductive terminal 2532 exposes the surface of the cover 25. The conductive terminal 2532 is electrically connected to the external circuit directly.

When assembling the speaker module 20, the method comprises the following steps:

Step S01, providing a housing 21, wherein the housing 21 comprises an accommodating space with an opening;

Step S02, providing a speaker unit 23, and correspondingly accommodating the speaker unit 23 in the accommodating space;

Step S03, providing a cover 25, wherein the cover 25 is provided and correspondingly covers the opening of the accommodating space of the housing 21. Meanwhile, the conductive pins 2531 of the conductive portion 253 abut against the working pad 231 of the speaker unit 23, as shown in FIG. 5.

Thus, the speaker module 20 is assembled.

In the speaker module 20 described above, the conductive pins 2531 of the conductive portion 253 are electrically connected to the conductive terminal 2532, therefore, when the conductive pin 2531 is electrically connected to the working pad 231 of the speaker unit 23, the conductive terminal 2532 is electrically connected to the working pad 231. When the conductive terminal 2532 is electrically connected to the external circuit, the generated drive signal can directly drive the speaker unit 23 to work through the conductive portion 253.

Meanwhile, the flexible printed circuit board is reduced, the rear cavity space of the speaker module 20 is saved, and the integration degree of products is improved. On the other hand, the number of elements is reduced, as a result, the assembling process is facilitated, and the working efficiency is improved.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A speaker module, comprising:

a housing;

a speaker unit comprising a frame and a working pad fixed to the frame for electrically connecting the speaker unit to an external circuit;

a cover engaging with the frame for forming an accommodating space for receiving the speaker unit; wherein the cover comprises a conductive part formed thereon, a conductive pin formed on one side of the cover for electrically connecting with the working pad of the speaker unit, and a conductive terminal formed on the other side of the cover for electrically connecting with the external circuit;

the conductive part is formed on the cover through an injection molding process, the conductive part penetrates through the cover body, and the conductive pins and the conductive terminals are respectively formed on two opposite sides of the cover;

the conductive pin includes a body, a connecting portion, an abutting body and an extending body; the body is embedded in the cover; two ends of the connecting body are respectively connected with one end of the abutting body; the extending body extends from the abutting body towards the cover; an end part of the extending body is embedded in the cover; and the abutting body is exposed out of the surface of the cover.

2. The speaker module as described in claim 1, wherein the number of the conductive parts is two, and the two conductive parts are symmetrically arranged on an edge of the cover.

3. The speaker module as described in claim 1, wherein the conductive terminal is formed on the surface of the body and is exposed out of the surface of the cover.

4. The speaker module as described in claim 3, wherein the conductive terminal is a metal conductive layer formed on the surface of the body, and the conductive terminal is electrically connected to the body of the conductive pin.

5. The speaker module as described in claim 4, wherein the metal conductive layer is any one of gold, silver, tin, copper and alloys thereof.

6. The speaker module as described in claim 1, wherein the abutting body abuts against the working pad of the speaker unit and is elastically sandwiched between the speaker unit and the cover.

7. The speaker module as described in claim 1, wherein the conductive part and the cover are integrally formed.

* * * * *